United States Patent [19]

Yoseloff

[11] 4,303,398

[45] Dec. 1, 1981

[54] ELECTRONIC QUIZ GAME UTILIZING CARTRIDGES AND METHOD EMPLOYING SAME

[75] Inventor: Mark L. Yoseloff, Simsbury, Conn.

[73] Assignee: Coleco Industries, Inc., Hartford, Conn.

[21] Appl. No.: 919,930

[22] Filed: Jun. 28, 1978

[51] Int. Cl.[3] ..... G09B 7/00

[52] U.S. Cl. ..... 434/335

[58] Field of Search ..... 35/8 R, 8 A, 9 A, 9 B, 35/9 D, 30, 31 R, 31 C; 434/335

[56] References Cited

U.S. PATENT DOCUMENTS

| | | | |
|---|---|---|---|
| 2,983,053 | 5/1961 | Bartholomew et al. | 35/9 B |
| 3,141,243 | 7/1964 | Chapman et al. | 35/9 A |
| 3,371,321 | 2/1968 | Adams | 35/8 R |
| 3,535,797 | 10/1970 | Leslie et al. | 35/9 A |
| 3,584,398 | 6/1971 | Meyer et al. | 35/31 R |
| 3,673,392 | 6/1972 | Holm | 364/606 |
| 3,780,450 | 12/1973 | Podkopaev et al. | 35/9 A |
| 3,787,988 | 1/1974 | Nakajima | 35/31 R |
| 3,832,790 | 9/1974 | Fryer et al. | 35/9 A X |
| 3,890,724 | 6/1975 | Hesener | 35/48 R |
| 3,924,339 | 12/1975 | Wilson et al. | 35/8 R |
| 3,934,226 | 1/1976 | Stone | 35/9 A |
| 3,934,229 | 1/1976 | Cochran | 364/900 |
| 3,944,983 | 3/1976 | Gale | 364/900 |
| 3,971,925 | 7/1976 | Wenninger | 235/156 |
| 3,974,575 | 8/1976 | Duncan | 35/9 A |
| 3,977,092 | 8/1976 | Duncan | 434/201 |
| 3,999,307 | 12/1976 | Tsuda et al. | 35/9 A |
| 4,001,947 | 1/1977 | Kilby | 35/9 B |
| 4,010,553 | 3/1977 | Bennett | 35/9 C |
| 4,010,556 | 3/1977 | Ellsworth et al. | 35/30 |
| 4,026,555 | 5/1977 | Kirschner et al. | 273/102.2 B X |
| 4,051,605 | 10/1977 | Toal et al. | 35/30 |
| 4,092,527 | 5/1978 | Luecke | 35/31 C |
| 4,095,791 | 6/1978 | Smith et al. | 273/DIG. 28 |
| 4,118,876 | 10/1978 | Brilakis | 35/9 A |
| 4,156,928 | 5/1979 | Inose et al. | 273/237 |
| 4,164,078 | 8/1979 | Goldfarb | 434/335 |

FOREIGN PATENT DOCUMENTS

| | | | |
|---|---|---|---|
| 1061392 | 3/1967 | United Kingdom | 434/335 |
| 116572 | 10/1969 | United Kingdom | 434/335 |
| 1308426 | 2/1973 | United Kingdom | 434/335 |
| 1315310 | 5/1973 | United Kingdom | 434/335 |
| 1332562 | 10/1973 | United Kingdom | 434/335 |
| 1341778 | 12/1973 | United Kingdom | 434/335 |
| 1429682 | 3/1976 | United Kingdom | 434/335 |
| 1438295 | 6/1976 | United Kingdom | 434/335 |

*Primary Examiner*—William H. Grieb

[57] ABSTRACT

An electronic question-and-answer device includes a keyboard on which codes associated with questions and answers may be entered. The device also includes indicator lights and a sound-generating device for indicating whether the correct answer has been entered on the keyboard. Circuitry is included that interprets the question code and answer code as numerical values and compares the numerical values entered thereby. In order that different correspondences between question codes and answer codes can be used with different sets of questions and answers, each set of questions and answers is provided with a different key-defining connector that connects the keyboard and internal circuitry in such a manner as to define the number entered by a given key.

18 Claims, 11 Drawing Figures

ELECTRONIC QUIZ GAME UTILIZING CARTRIDGES AND METHOD EMPLOYING SAME

BACKGROUND OF THE INVENTION

The present invention relates to the field of nonmathematical question-and-answer games, particularly of the type disclosed in Goldfarb U.S. Pat. No. 4,164,078.

In devices of this type a question is selected, and a code associated with the selected question is entered on a keyboard. The keyboard in turn enters a numerical value into a storage-and-comparison circuit. A code associated with a selected answer is then entered on the keyboard, a corresponding numerical value thereby also being entered into the storage-and-comparison circuit. The circuit compares the entered numerical values, and since the question codes and answer codes are prearranged so that the numerical value entered by the correct-answer code corresponds to the numerical value entered by the question code, an indication can be given of whether or not the operator has selected the correct answer.

Devices of this type are particularly advantageous because they can employ calculator-like circuits to avoid extensive memory of individual answers. The simplicity associated with such circuits is thus achieved, as is the accompanying low price. However, it may be anticipated that some operators will memorize the correspondence between question codes and answer codes after long use and thus deprive the game of some of its interest. Accordingly, it would be desirable to be able to change the correspondence between question codes and answer codes in a manner simple enough to comport with the placement of the device in the lower-price and of the consumer market. As indicated in the Goldfarb application, hereby incorporated by reference, the prior art includes devices in which new sets of questions and answers can be employed, and means are provided in those devices to adapt them to a change of questions and answers. However, the methods employed to adapt the prior art devices to changing questions and answers require individual storage elements such as holes punched in cards for each separate question and set of answers. These arrangements are somewhat unwieldy, lacking the simplicity of the device of the present invention.

Accordingly, there is provided by means of the present invention a method and apparatus for changing the correspondence between question codes and answer codes without necessitating an individual entry for new question-answer pairs. Simplicity and low cost are thereby afforded.

SUMMARY OF THE INVENTION

According to the present invention, a storage-and-comparison circuit that includes storage-and-comparison-circuit terminals is provided. Numerical values are enterable by connection of pairs of the terminals, and the circuit is operable to perform a multivariate logical operation on entered numerical values to enter a resultant numerical value and to compare the resultant numerical value with an entered numerical value by connection of pairs of the storage-and-comparison-circuit terminals. The circuit has at least one comparison-result terminal for carrying signals indicative of the result of the comparison. Also provided is a keyboard having keyboard terminals and a multiplicity of keys. Each key has a pair of keyboard terminals associated with it, the key being operable to connect its associated terminals. Removable connector means are simultaneously connected to some of the storage-and-comparison-circuit terminals and some of the keyboard terminals. The removable connector means provide connection circuitry that electrically connects some of the storage-and-comparison-circuit terminals to some of the keyboard terminals so as to connect some of the storage-and-comparison-circuit terminal pairs when some of the keys are operated. The connection circuitry is arranged for entry of numerical values and performance by the storage-and-comparison circuit of the logical operation when some of the keys are operated and for comparison of the resultant numerical value with an entered numerical value when at least one of the keys is operated. By virtue of this arrangement, numerical values entered by operation of the keys may be changed by substituting a different connector means in which the connection circuitry is arranged differently between the storage-and-comparison-circuit terminals and the keyboard terminals. In order to produce a humanly detectable translation of the signals present on the comparison-result terminal, indicator means are provided that are connected to the comparison-result terminals of the storage-and-comparison circuit.

According to one embodiment of the invention, some of the storage-and-comparison-circuit terminal pairs each consists of two terminals, one being an entry terminal for entering into the storage-and-comparison circuit as a digital number a signal impressed on that terminal and the other being a logic-signal terminal that presents either a logic "0" signal or logic "1" signal. According to this embodiment, the connector means is arranged to electrically connect some of the logic signal/entry terminal pairs through operation of some of the keys; the numerical values entered upon operation of some of the keys are thereby dependent on the connection circuitry of the removable connector means.

According to a different embodiment of the present invention, the storage-and-comparison circuit includes an integratedcircuit calculator chip, and the logical operation is an arithmetic operation. Sequential connection of some pairs of the storage-and-comparison-circuit terminals enters operand numerical values into the calculator chip and cause it to perform an arithmetic operation on the resultant operands; this enters the numerical value that is the answer to the operation into the calculator chip. In this arrangement, the connection circuitry is arranged for this sequential connection of storage-and-comparison-circuit terminals upon sequential operation of some of the keys. A code may thereby consist of a sequence of characters that corresponds to the sequential operation of keys, so operation of the keys corresponding to that code enters the numerical value that is the answer to the arithmetic operation.

According to one refinement, which can be employed with either of the previously mentioned embodiments, the connector means includes a printed-circuit board. The connection circuitry includes electrically conductive landing areas and electrically conductive paths that electrically connect pairs of the landing areas. The keyboard terminals and the storage-and-comparison-circuit terminals that are electrically connected to the connector means are connected electrically to the landing areas by conductors connected to those terminals and terminating in electrically conductive contact members. These contact members removably contact the landing areas, so a keyboard terminal that is electrically connected to a first landing area is electrically connected as a result to the storage-and-comparison-circuit terminal that is connected to the landing area to which the first landing area is connected by the printed-circuit-board paths.

The keys provided in the various embodiments of the present invention are preferably labeled with distinctive indicia, and means are provided for listing question and associated sets of answers. Each question is associated with a question code that consists of at least two of the keyboard indicia. One answer of each set is predetermined the correct answer, and each of the answers is associated with an answer code that also consists of at least one of the keyboard indicia.

The listing means may be secured by appropriate means to a base member, and a housing can be provided to enclose the storage-and-comparison circuit. The keys may be mounted on a face of the housing, and means may be provided on the base member to engage the housing so as to removably secure it to the base member.

The base member, with or without a listing means secured to it, may further include means for securing the printed-circuit board to the base to align the landing areas with the removable contact means. Removal of the housing from the base member would thereby remove the landing areas of the printed-circuit board from contact with the contact members.

The listing means may include a booklet bearing a visual listing of the questions, answers, and codes.

The indicator means may include an indicator light connected for illumination upon reception of signals that indicate the choice of a correct answer. It may also include a second indicator light that is arranged for illumination upon the reception of signals that indicate the choice of an incorrect answer. In addition, the indicator means can include a soundgenerating device for selectively producing one of two distinct tones, one of the tones indicating a correct answer and the other indicating an incorrect answer.

A method for use with the apparatus of the present invention is a method for changing the numerical values that are entered by operating given keys on the keyboard. In order to perform this change, the removable connector is removed from the storage-and-comparison-circuit and keyboard terminals to which it is electrically connected, and a second removable connector means is connected to some of the storage-and-comparison-circuit terminals and some of the keyboard terminals. The second removable connector means, when so connected, provide connection circuitry that differs from the connection circuitry of the first removable connector means. This connection circuitry electrically connects some of the storage-and-comparison-circuit terminals to some of the keyboard terminals for connection of some of the storage-and-comparison-circuit terminal pairs upon operation of some of the keys. The differing connection circuitry is arranged for entry of numerical values upon operation of some of the keys and performance of the logical operation upon operation of at least one of the keys, but the correspondence between keys and numerical values resulting from the differing connection circuitry is different from the correspondence that results from the connection circuitry of the first removable connector means. Thus, the resultant numerical values entered by operation of the keys is changed.

Preferably, first and second base members are provided that have means on them for securing the first and second connector means, respectively. A housing enclosing the storage-and-comparison circuit is provided in this preferred method, and keys are located on the face of the housing. The first base member includes means removably engaging the housing so that the removal step includes removing the housing from engagement with the engagement means on the first base member. The second base member includes means for removably engaging the housing so that the step of connecting the second connector means includes engaging the housing with the engagement means on the second base member.

In the preferred embodiment, the first and second connector means include first and second printed-circuit boards, respectively, and the connection circuitry of the first connector means includes electrically conductive landing areas on the first printed-circuit board. Electrically conductive paths are provided on the first printed-circuit board that electrically connect pairs of its landing areas. The different connection circuitry of the second connector means also include electrically conductive landing areas on it, and electrically conductive paths also electrically connect pairs of the landing areas of the second printed-circuit board. The steps of providing the keyboard and the storage-and-comparison circuit include connecting some of the terminals of the storage-and-comparison circuit and the keyboard to some of the landing areas of the first printed-circuit board by means of conductors connected to some of the terminals and terminating in electrically conductive contact members that are removably connected to the landing areas of the first printed-circuit board. The means on the first base member that secure the first connector means include means that secure the first printed-circuit board to the first base member in alignment with the contact members. Likewise, the means on the second base member that secure the second connector means include means that secure the second printed-circuit board to the second base member for alignment with the removable contact members when the engagement means on the second base member engages the housing.

The accompanying specification also teaches a method of playing a question-and-answer game. It includes providing the storage-and-comparison circuit and keyboard previously mentioned, and each of the keys on the keyboard is labeled with a distinctive indicium. Connector means are also provided according to this method, the connector means being simultaneously electrically connected to some of the storage-and-comparison-circuit terminals and some of the keyboard terminals. The connector means provide the connection circuitry described above. Also provided as before are the indicator means and the listing of questions and associated sets of answers. To play the game, one selects from the listing a question whose question code consists of at least two of the keyboard indicia and operates the keys labeled with the indicia of which the selected question code consists. A first numerical value is thereby entered. The player also selects an answer from the set of answers associated with the selected question and operates keys labeled with the indicia of which the code associated with the selected answer consists, thereby entering another numerical value. By operating a key whose operation causes the storage-and-comparison circuit to compare entered numerical values, the player causes the storage-and-comparison circuit to compare the resultant and other numerical values, and he observes the translation produced by the indicator means. He can thereby determine whether the selected answer is the predetermined correct answer associated with the selected question.

Preferably, the connector means are removable, and the method of playing the game includes removing them. A second removable connector means is then connected to some of the storage-and-comparison-circuit terminals and some of the keyboard terminals. When so connected, it provides connection circuitry that differs from the connection circuitry of the first removable connector means and electrically connects some of the storage-and-comparison-circuit terminals to some of the keyboard terminals for connection of some of the storage-and-comparison-circuit terminal pairs upon operation of some of the keys. The differing connection circuitry is arranged for entry of numerical values and performance of the logical operation upon operation of some of the keys, the correspondence between keys and numerical values resulting from the differing connection circuitry of the second removable connector means differing from the correspondence resulting from the connection circuitry of the first removable connector means. Removal of the first connector means and the connection of the second connection means thereby changes the resultant numerical values entered by operation of the keys. A second listing of question and associated sets of answers is provided in the preferred game-playing method, and some of the questions are associated with question codes that consist of at least two of the keyboard indicia. One answer of each set is predetermined the correct answer, and each answer is associated with an answer code consisting of at least one of the keyboard indicia, the numerical value entered by operation of the keys labeled with the indicia of which a question code consists being equal to the numerical value entered by operation of the key labeled with the indicia of which the associated correct-answer code consists when said second removable connector means has been connected. A question whose code consists of at least two keyboard indicia is selected from the second listing, and the player operates the keys labeled with the indicia of which the question code selected from the second listing consists. A second resultant numerical value is thereby entered. The player again selects an answer from the set of answers associated with the question he has just selected and operates keys labeled with the indicia of which the code associated with the answer consists, thereby entering a further numerical value. By operating a key whose operation causes the storage-and-comparison circuit to compare entered numerical values, he causes the storage-and-comparison circuit to compare the second resultant and further numerical values, and he observes the translation produced by the indicator means. He can thereby determine whether the selected answer is the predetermined correct answer associated with the question selected from the second listing.

BRIEF DESCRIPTION OF THE DRAWINGS

These and further features and advantages of the present invention become evident by reference to the attached drawings, in which.

DETAILED DESCRIPTION OF THE PREFERRED EMBODIMENT

Figure 1:
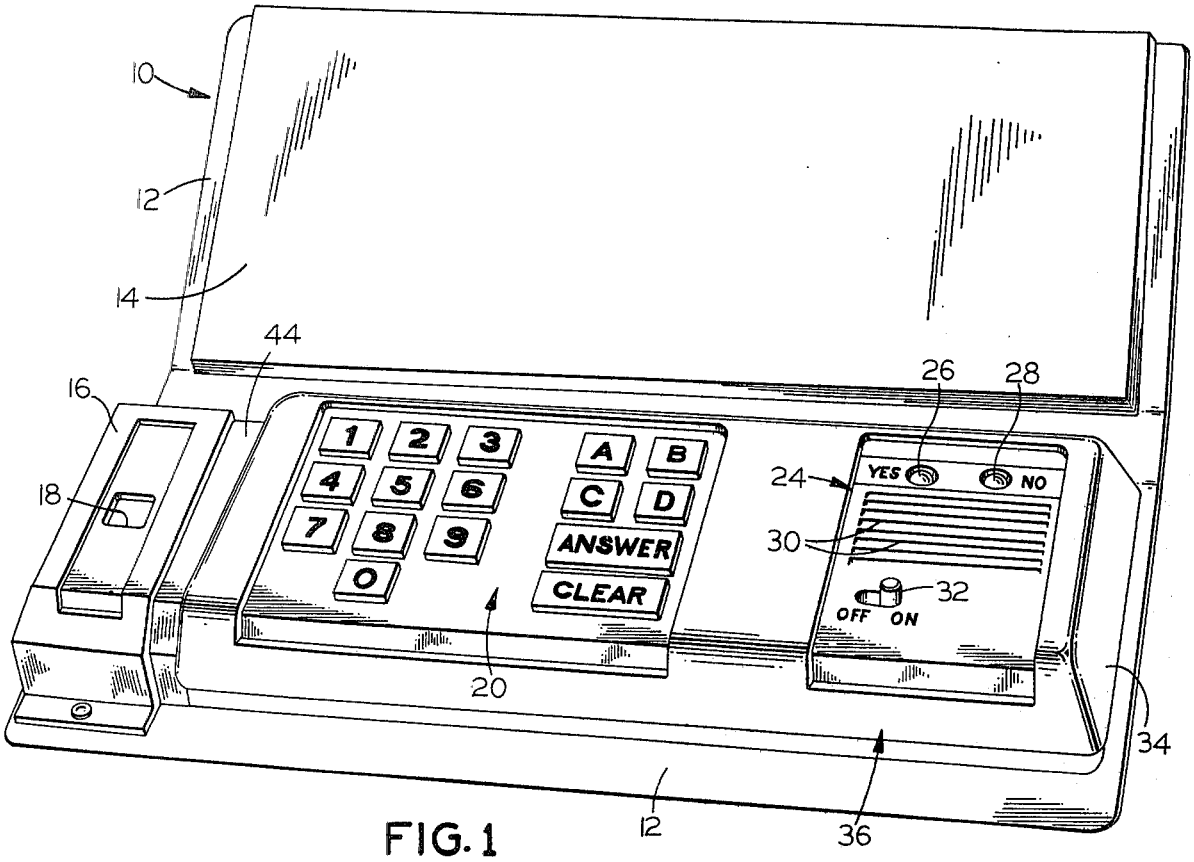
FIG. 1 is a perspective view of a preferred embodiment of the present invention.

FIG. 1 is a perspective view of the question-and-answer unit of the present invention, indicated generally by reference 10. The unit includes a plastic base 12 that is hinged to open and close like a book. A means fo providing a listing of questions, answers, and associated codes is exemplified by a booklet 14 suitably attached to the upper half of the base and the booklet contains questions and answers, together with associated codes, for use with the unit.

A cartridge assembly is shown secured to the lower left side of the base 12, the cartridge assembly comprising a cartride cover 16 that houses a small printed-circuit board. An opening 18 is provided in the housing so that the printed-circuit board, of which there are several variations, may be identified. A removable electronics unit, indicated generally by reference 36, is removably attached to the cover adjacent to the cartridge cover 16. The electronics unit includes a housing 34 in which a keyboard 20 is mounted. The keyboard includes keys for completing circuitry largely contained in the electronics unit 36 beneath the housing 34. The electronics-unit housing 34 also includes an indicator section 24 on which a green YES light 26 and a red NO light 28 are mounted. Vents 30 for transmission of sound from a sounder mounted below the indicator section 24 are also included, as is an on-off switch 32.

Figure 2:
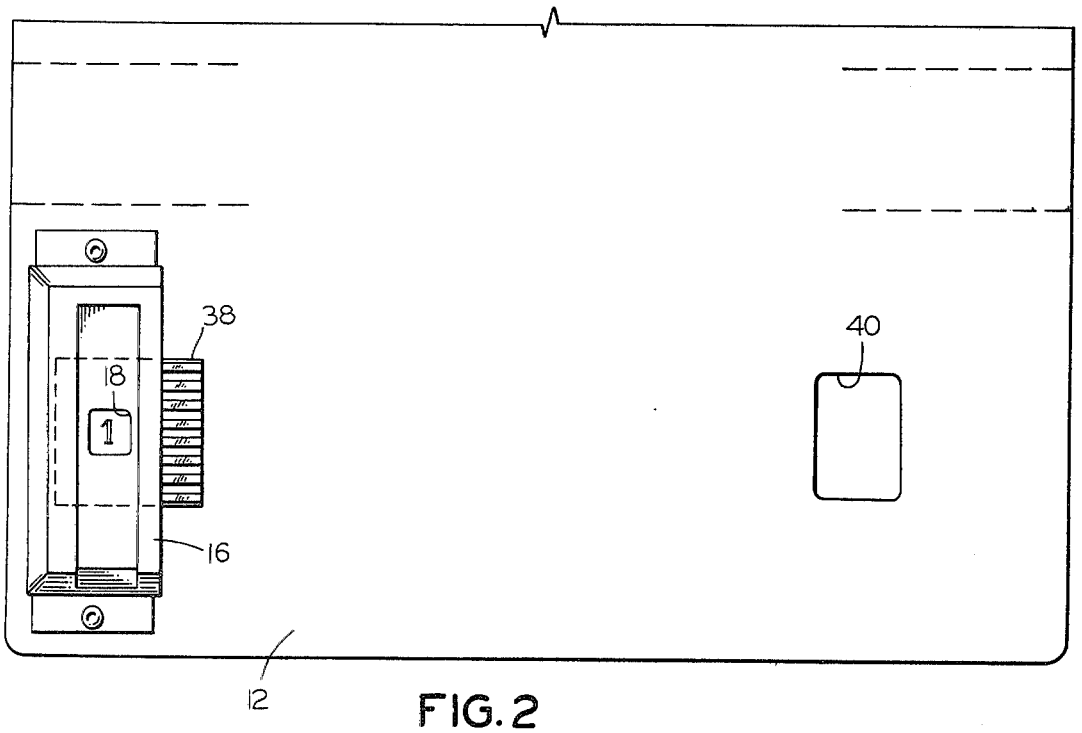
FIG. 2 is a plan view of the horizontal portion of the cover and cartridge assembly of the question-and-answer device of FIG. 1 with the electronics unit removed.

FIG. 2 shows the question-and-answer unit with the electronics unit 36 removed. Removal of the electronics unit 36 leaves the base 12 itself, the cartridge cover 16, and a printed-circuit board 38 attached to the housing. Also shown in FIG. 2 is an opening 40 by which a plastic finger depending from the bottom of the electronics unit engages the base. The printed-circuit board 38 contains no circuit elements as such, but merely connections. It is these connections that determine the correspondence between questions and correct answers that will be recognized by the electronics unit; no memory elements such as tape or solid-state read-only memory are necessary with the device of the present invention, and no reprogramming of the electronics unit is required to change the correspondence between questions and answers. All that is required to change the correspondence is a version of the printed-circuit board whose connecting circuitry is arranged differently. It is for this reason that an opening 18 is provided in the cartridge cover 16; it may be necessary on some occasions to determine that the correct printed-circuit board is provided for the booklet being used. Thus, the printed-circuit board in each cartridge has an identifying number such as the number "1" in FIG. 2 to ensure the operator that the correct printed-circuit board is being used.

Figure 3:
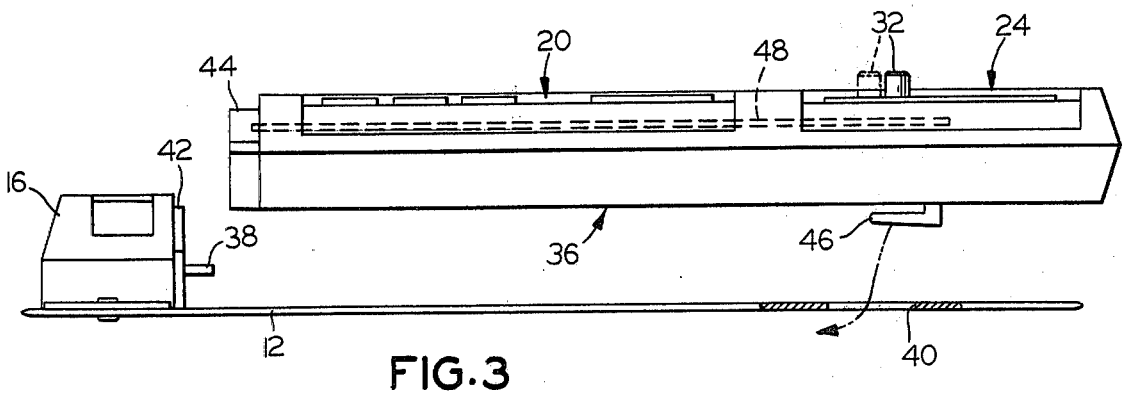
FIG. 3 is a side elevation, partly in section, of the horizontal part of the question-and-answer unit with the electronics unit shown disconnected from the cartridge assembly.

FIG. 3 is a side elevation of the cartridge and the horizontal part of the base 12 with the electronics unit 36 positioned in preparation for attachment to the base 12. The cover 12 is broken away at its right side to show the region around the opening 40 in cross section. The side elevation shows a shelf 42 on the cartridge cover 16. This shelf is provided for alignment with a short sleeve 44 formed on the left end of the housing 34. The electronics unit is inserted by aligning the sleeve 44 with the shelf 42 and maneuvering finger 46 through the opening 40 in the cover. The electronics unit is then slid to the left so as to engage springs not shown in FIG. 3 and to position the finger so that it secures the electronics unit vertically.

Figure 4:
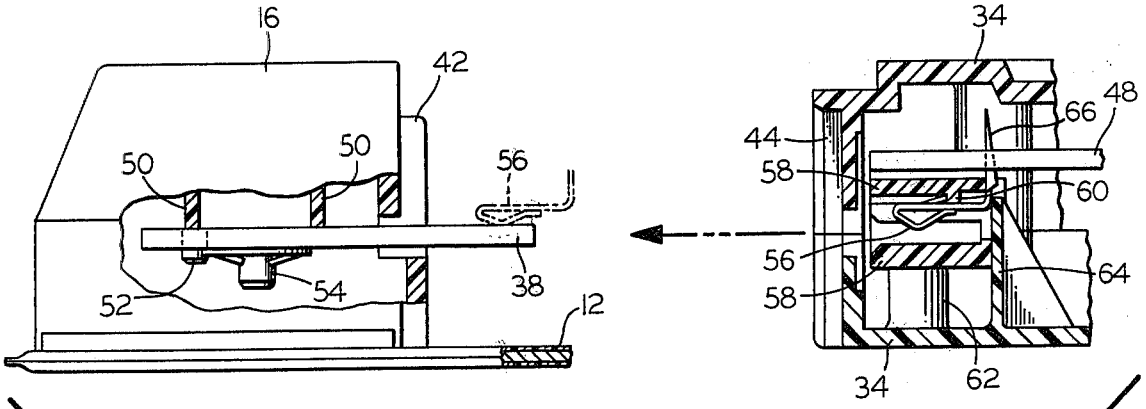
FIG. 4 is a detail of FIG. 3 showing the cartridge assembly and the part of the electronics unit that mates with it, partly in section.

FIG. 4 shows the engaging of the electronics unit with the cartridge assembly in greater detail. It shows the cartridge cover 16 in place on the base 12, and the housing is partially broken away to show the printed-circuit board 38 in place. Vertical wall members 50 that define the opening 18 brace the printed-circuit board 38 to prevent upward motion. Positioning pins 52, one of which is seen in FIG. 4, are formed on one of the walls 50 and extend through openings formed in the printed-circuit board 38 for proper positioning thereof. Other walls, oriented transverse to wall members 50 and therefore not seen in section, also extend down to brace printed-circuit board 38. Mounting nipples 54 are formed on the ends of the transverse walls. These nipples extend through openings in the printed-circuit board 38 during manufacturing and then are heat formed to engage the printed-circuit board area surrounding the openings, thereby securing the printed-circuit board in place.

Also shown in FIG. 4 is the left end of the electronics unit indicated in its entirety by reference numeral 36 in FIG. 3 and shown in section in FIG. 4. Its housing 34, which encloses the electronics unit 36, is seen in section. The short sleeve 44 is seen extending from the left end of the housing 34, and it is seen on end because it is hollow. A spring-contact housing 58 is mounted inside the electronics-unit housing 34 by means of a support member 62 and a wall member 64 that extend from the lower surface of the housing. Spring contacts 56 are mounted in the spring-contact housing 58 and are biased by bosses 60 formed in the housing 58. The individual springs terminate in dagger sections 66, which penetrate the spring-contact housing 58 and a printed-circuit board 48 that is mounted in the housing. Comparison and storage circuitry is mounted on this printed-circuit board. The spring contact 56 is shown in phantom in FIG. 4 in the position that it takes when the electronics unit is in proper position with respect to the cartridge assembly. The spring contacts 56 contact conductive landing areas on the cartridge-assembly printed-circuit board 38 in order to make electrical contact between the conductor paths on the cartridge-assembly printed-circuit board 38 and signal paths on the storage-and-comparison-circuit printed-circuit board 48.

Figure 5:
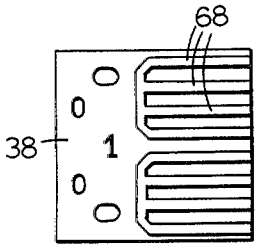
FIGS. 5 and 6 are plan views of examples of the cartridgeassembly printed-circuit board shown in FIG. 4.
Figure 6:
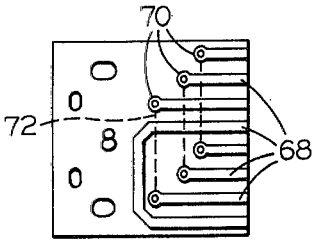
Figure 7:
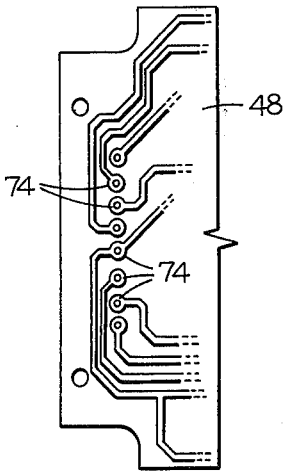
FIG. 7 is a plan view of part of the printed-circuit board of the electronics unit.

The interconnection between the cartridge assembly and the electronics unit can be better appreciated by referring to FIGS. 5, 6, and 7. FIG. 5 shows various conductor areas that terminate in elongated landing areas 68 for the spring contacts 56. Upon engagement of the cartridge assembly with the electronics unit 36, the spring contacts contact the elongated landing areas 68 so that printed-circuit board 38 may interconnect various parts of the circuit that includes the circuitry on printed-circuit board 48.

The printed-circuit board of FIG. 5 is not the only arrangement possible, and when a different correspondence between question codes and answer codes is desired, a different printed-circuit board is used. An example of such a different printed-circuit board is illustrated in FIG. 6, which also has elongated spring-contact landing areas 68. Since its arrangement is different, the printed-circuit board of FIG. 6 has a different identifying character. Also, since the interconnection desired is not topologically possible using only one side of a printed-circuit board, it is necessary that holes 70 be provided so that interconnections can be made between the elongated landing areas 68 by using jumpers 72, shown in phantom in FIG. 6, that are secured to the other surface of the printed-circuit board.

FIG. 7 shows a typical arrangement for the left end or the printed-circuit board 48 contained in the electronics unit 36. Various conductor areas are shown that are similar to those in FIGS. 5 and 6, but the printed-circuit board is broken off to indicate connection to the keyboard and to storage-and-comparison circuitry and keyboard terminals also contained in the electronics unit 36. The holes 74 in the conductor areas of the printed-circuit board of FIG. 7 are provided for engagement by the dagger sections 66 (FIG. 4) of the spring contacts 56. Thus, upon engagement of the electronics unit and the cartridge assembly, the spring contacts 56, which already are electrically connected to the conductor paths of the printed-circuit board 48, contact the landing areas 68 on the cartridge printed-circuit board 38, thereby making the desired interconnections. As is discussed below, this interconnection provides desired connections between the keyboard and the storage-and-comparison circuitry, and different arrangements of the cartridge printed-circuit boards permit different definitions of the meanings to the storage-and-comparison circuitry of the various keys on the keyboard.

A wide variety of storage-and-comparison circuitry can be employed to realize an embodiment of the present invention. One example, for instance, uses a keyboard arrangement that is different from that in FIG. 1 but can still employ the unique method of changing the correspondence between question codes and answer codes taught in the present specification. Using the keyboard of FIG. 8, the operator first presses the CLEAR button to initialize the circuit and then enters a three-character code that is associated with a question that he is attempting. In this particular arrangement, each question has a code in the form of a letter, a number, and a letter, such as C1B. Each answer also has a code, the answer codes being in the form of two letters, such as BG. In order to determine whether or not he has picked the correct answer, the operator enters the three-character question code, presses the ANSWER button, then enters the two-letter code of the answer that he has chosen. He then operates the PLS button, the CHK button, and the question-mark button. When the question-mark button is pressed, the electronics unit either lights the green YES light and emits a high-pitched tone or lights the red NO light and emits a low-pitched tone. The circuitry for accomplishing this result is illustrated schematically in FIG. 9.

Figure 9:
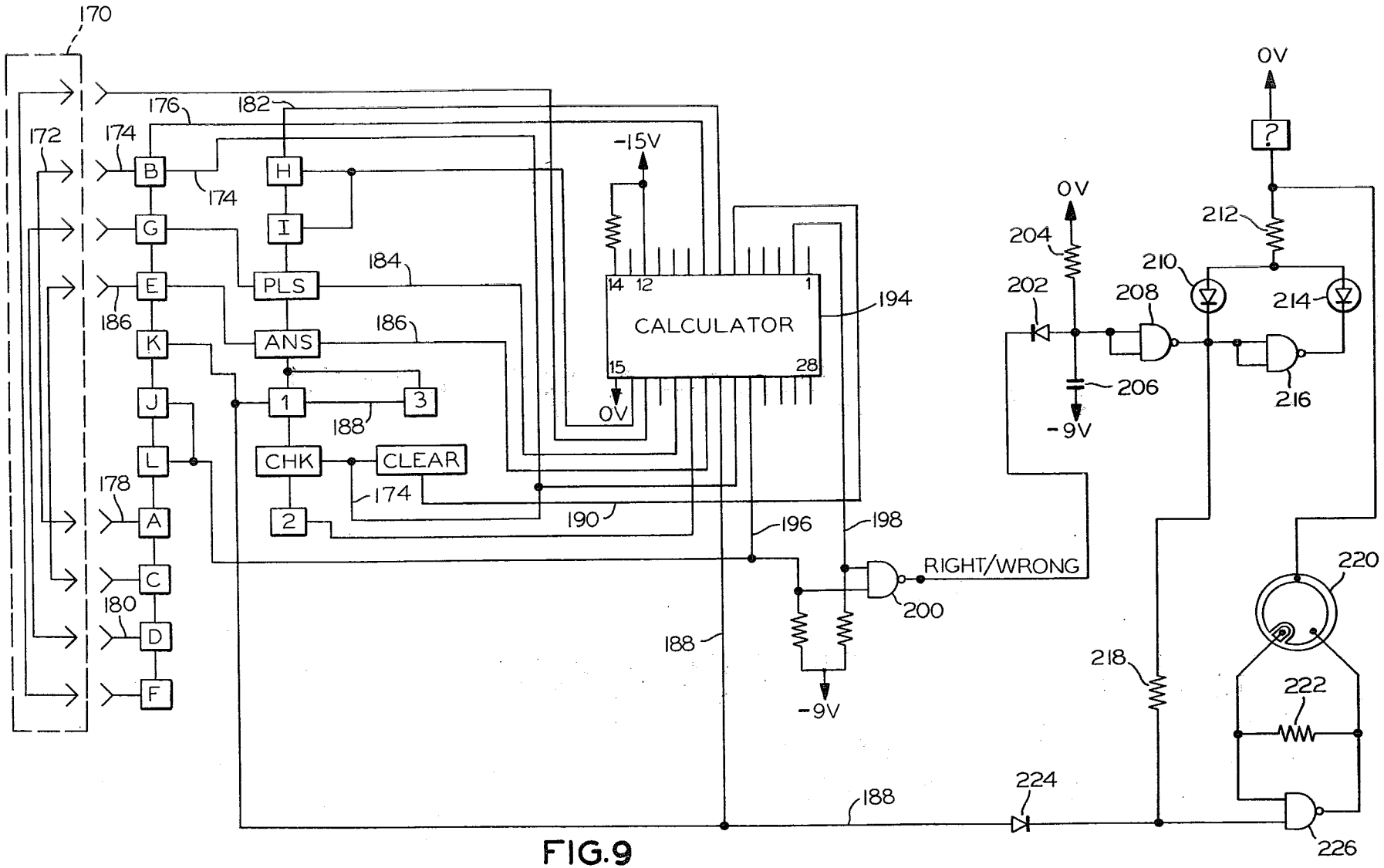
FIG. 9 is a schematic diagram of the circuitry for an embodiment whose keyboard arrangement is shown in FIG. 8.

A calculator chip 194 is shown in FIG. 9 appropriately connected to receive proper power for operation. The chip is one of a variety of now-common integrated circuits arranged for performance of arithmetic operations. Numbers are entered by connecting pairs of the terminals on the chip, and connection of terminal pairs is also used to perform the arithmetic operations on the entered numbers.

Figure 8:
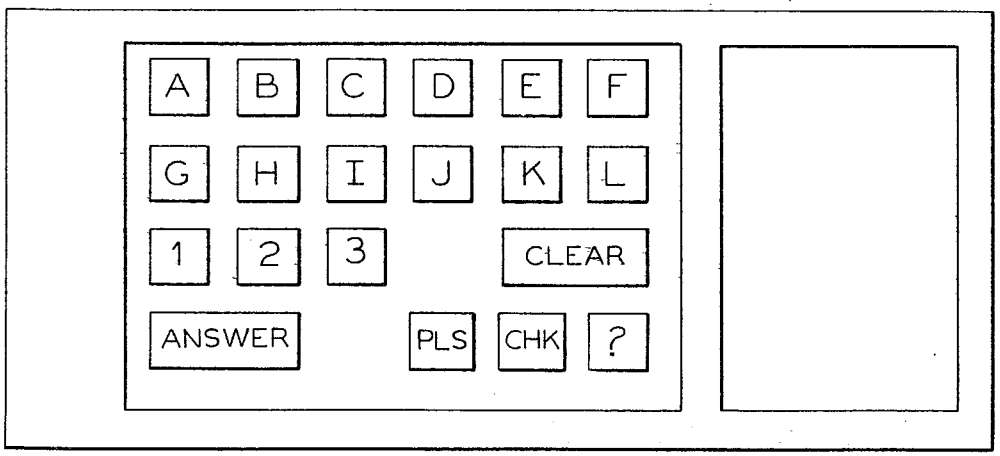
FIG. 8 is a diagram of an alternate arrangement of the keyboard.

Connection of pairs of the calculator terminals is accomplished through cooperation of the keys of FIG. 8 with the connector means exemplified by the printed-circuit boards of FIGS. 5 and 6 and represented in FIG. 9 by dashed lines 170. The keys of FIG. 8 appear in FIG. 9 with corresponding indicia, and with the exception of the question-mark key, they are depicted in a matrix representation; that is, a horizontal line passing through a key symbol represents a connection to one of the terminals of the key, while a vertical line represents a connection to its other terminal.

As an example of the way in which the calculator chip 194 is used to perform the question-and-answer function, let it be assumed that a question has the code A1A. The operator enters the question code by operating the keys in sequence that correspond to these indicia. He first operates the "A" button. This connects a pair of calculator terminals consisting of the terminal connected to line 174 and the one connected to line 176. It is to be noted that this connection involves the connection circuitry of the connector means 170; in particular, it involves line 172, which connects line 174, a calculator terminal, to line 178, a keyboard terminal. It will be appreciated that line 172 represents one of the printed circuit conductive paths that connects two landing areas 68 electrically connected by means of spring contacts to the terminals represented by lines 174 and 178.

Though other arrangements are possible, of course, it is convenient for the operation of keys whose indicia are letters of the alphabet to enter numerical values, as opposed to arithmetic operations, into the calculator chip 194. Thus, it can be assumed that connection of the calculator terminals connected to lines 174 and 176 (that is, those that are connected by operation of the "A" key) will enter a numerical value, say 6, into the calculator.

It is also convenient for the depression of keys whose indicia are numbers to signify operations such as addition or subtraction to the chip. Thus, when the "1" key is depressed, a signal representing an arithmetic operation, say addition, is entered by connection of the calculator terminals that are connected to lines 182 and 188. Depressing the "A" key again completes entry of the question code and effectively stores the number 12, since the sequence A1A enters "6+6" into the calculator.

In order to enter the chosen answer, the operator presses the ANSWER key followed by an answer code, typically a two-letter sequence such as ED. Depression of the ANSWER key connects lines 182 and 186, signifying subtraction to the calculator, and depression of keys E and D connects lines 176 and 186 as well as lines 176 and 180. If ED causes the entry of the numerical value 12 into the calculator, then the numerical value entered by the question code equals the number entered by the answer code. Furthermore, through operation of the ANSWER key, the calculator is set up to compare the entered numerical values; the calculator has had the sequence 6+6−12 entered, and execution of this arithmetic problem yields zero if the question code and answer code result in equal numerical values.

The comparison having been set up, it is then carried out and the results indicated through operation of the following sequence of keys: PLS CHK ?. Connection of lines 182 and 184 by operation of the PLS key enters a signal representing division, which completes execution of the previously posed problem, 6+6−12, and enters the result, zero, as the divisor of a new problem. Connection of lines 174 and 182 by the CHK key causes execution of the division problem—as would depression of the equals-sign (=) key on some calculators—thereby directing the calculator to divide by zero, which results in an overflow. An overflow causes high signals to be present on lines 196 and 198 simultaneously, causing the output of the NAND gate 200, to whose input terminals they are connected, to go low.

The output of NAND gate 200 is a signal that indicates the result of the comparison. If it goes low, as just described, the indication is that numerical values entered by the codes are equal. If the numerical values are not equal, an overflow does not result, and simultaneous high signals are not presented to NAND gate 200. A steady high output thereby results, and inequality is indicated.

The circuitry in FIG. 9 to the right of NAND gate 200 constitutes means for producing a humanly detectable indication of the signal produced as the output of NAND gate 200. Operation of the question-mark key applies power to red and green LED's 210 and 214 through resistor 212. The signals presented to NAND gate 200 are actually pulses, so the correct-answer output of NAND gate 200 is a series of negative-going pulses, whereas the wrong-answer output is a steady high signal. Therefore, if the correct answer has been chosen, the negative-going pulses are applied to diode 202, forward biasing it to drop voltage across resistor 204 and repeatedly discharge capacitor 206. The time constant of the resistor 204-capacitor 206 combination is such that capacitor 206 is not allowed to charge high enough to present a high signal to inverting amplifier 208. As a result, the output of inverting amplifier 208 is high, preventing the red, or wrong-answer, LED 210 from lighting. The high output of inverting amplifier 208 causes a low output at inverting amplifier 216, so current is drawn through the green, or correct answer LED 214. A visual indication is thereby provided to the operator.

Depressing the question-mark keys also provides an audible indication to the operator because power is thereby applied to a piezoelectric transducer 220. If the correct answer has been chosen, the high-signal output of inverting amplifier 208 is applied through resistor 218 to back bias diode 224 and thereby isolate NAND gate 226 from the signal on line 188. One input of NAND gate 226 thereby remains high while the other input receives feedback through resistor 222 and the piezoelectric transducer 220. The circuit resonates at the natural frequency of the transducer, and a high-pitched tone is thereby produced, indicating a correct answer. The circuit is readied for entry of another answer by depressing the CLEAR button to connect the terminals represented by lines 174 and 190.

In the event of an incorrect answer, a low output signal from inverting amplifier 208 is applied to diode 224 through resistor 218, allowing diode 224 to conduct and thereby permit the signal on line 188 to be applied across resistor 218. The signal on line 188 is a low-frequency pulse whose pulse-repetition frequency corresponds to a low-pitched audible tone. This signal is applied as one of the inputs to NAND gate 226, synchronizing its output signal with the signal on line 223. The piezoelectric transducer 220 thus vibrates at a low pitch, signifying to the operator that he has chosen incorrectly.

It should be noted that the numerical values entered by operating the keys depend on the arrangement of the connector means 170. Had the connector means connected line 178, the "A" key terminal, to line 186 instead of line 174, for instance, operation of the "A" button would have entered a 1 instead of a 3. Therefore, substitution of a different connector means having connection circuitry arranged differently can change the numerical value entered by a given key, thereby changing the correspondence between question codes and correct-answer codes.

Figure 10:
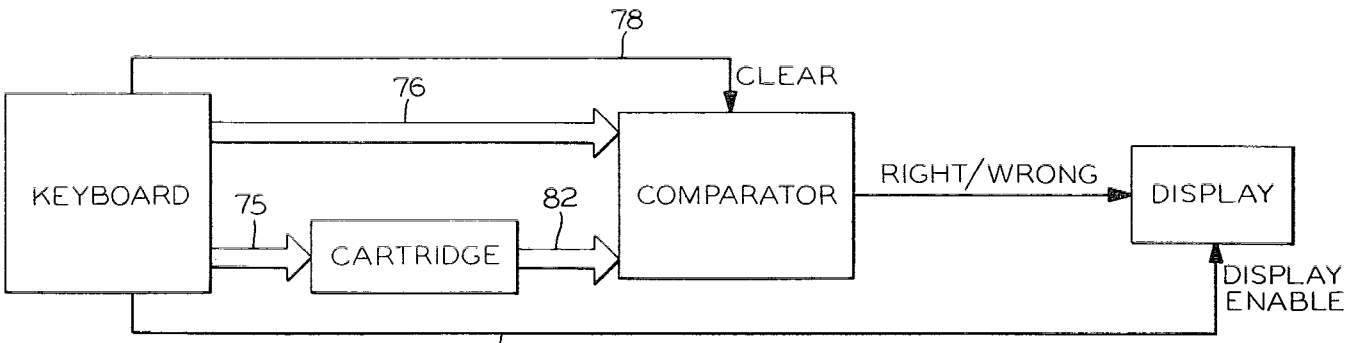
FIG. 10 is a conceptual illustration of the interrelationship of the cartridge of the present invention with the keyboard and circuitry.

It can be seen that this circuitry performs the function illustrated diagrammatically in FIG. 10. Information is entered from the keyboard onto the storage-and-comparison circuitry labeled "comparator" in the drawing. The operation of some of the keys is independent of the arrangement of the cartridge printed-circuit board, and this fact is suggested by arrow 76 of FIG. 10. Initialization is also independent of the cartridge used, and this is indicated by arrow 78. Furthermore, the lights and buzzer are enabled independently of the arrangement of the cartridge, as is indicated by arrow 80. However, as arrows 75 and 82 indicate, the data entered into the storate-and-comparison circuit through the operation of a key is in at least some cases determined by the arrangement of the cartridge.

Figure 11:
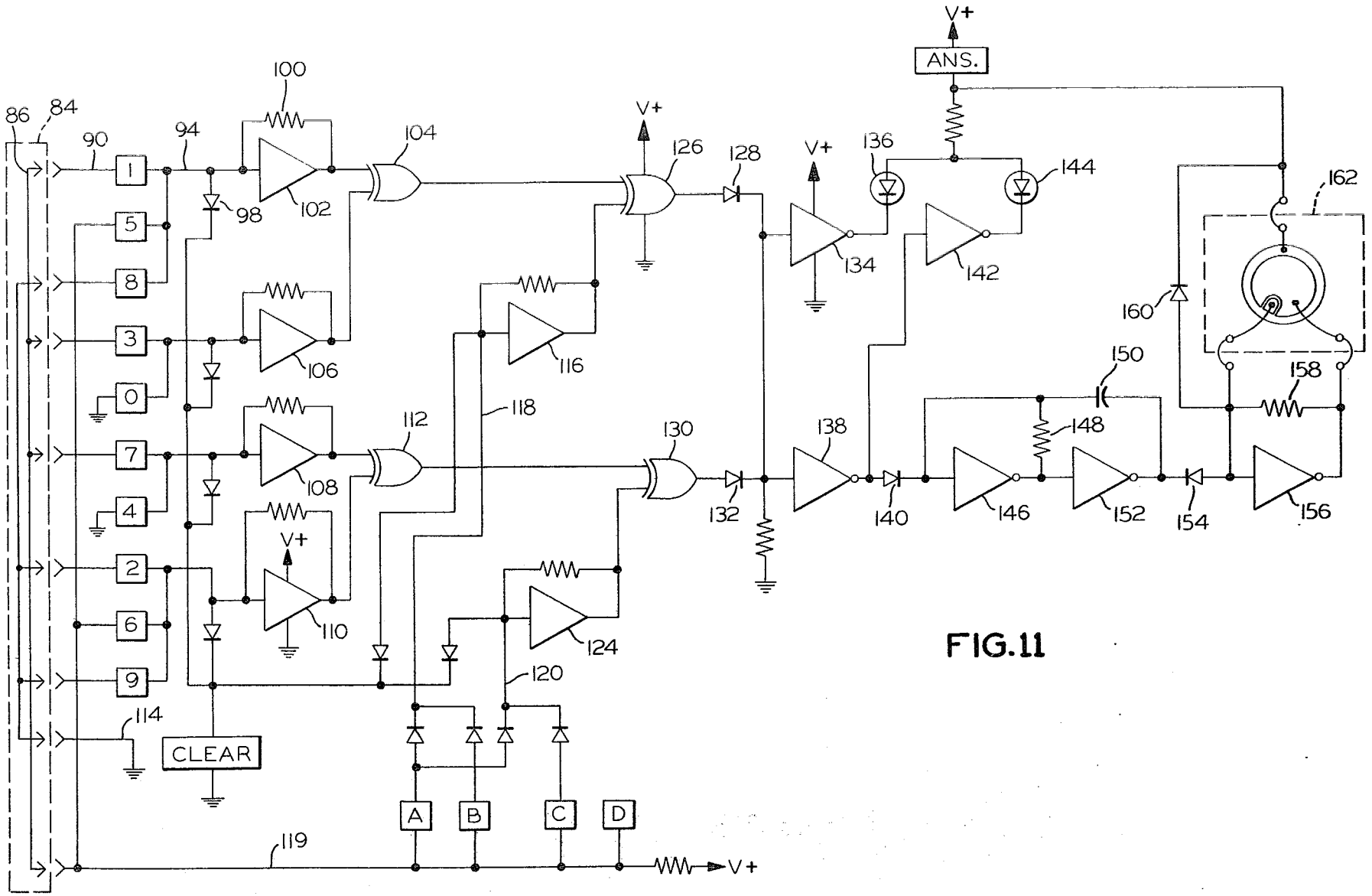
FIG. 11 is a schematic diagram of circuitry for use with the keyboard arrangement illustrated in FIG. 1.

Another embodiment of the same teaching is shown schematically in FIG. 11, which is a schematic diagram of an embodiment of the present invention that does not employ a calculator-type chip. In this arrangement, the keyboard arrangement of FIG. 1 is employed, and the question code is entered in the form of numbers, while the answer code takes the form of one of the four letters. The operator presses the CLEAR button to initialized the circuitry and then enters the question code, which is in the form of one or more numbers. The answer, typically in the form of one letter, is then entered, and the ANSWER button is pressed to enable the display, which displays a green light and a high-pitched tone for a correct answer and a red light and a low-pitched tone for an incorrect answer.

The circuit by which this result is reached is shown schematically in FIG. 11, in which each number button is shown having its output terminal connected to the input terminal of the buffers 102, 106, 108, and 110. For instance, the "1" button is connected by line 94 to the input terminal of buffer 102. Buffer 102 is provided with positive feedback through the provision of resistor 100, so it acts as a latch; a high signal on the output of buffer 102 causes a high signal at its input terminal, maintaining the high condition until a low signal from a relatively low-impedance source is applied to its input terminal. At that point, its output goes low, again remaining at the low level until a high signal from a relatively low-impedance source is applied. Thus, operation of the "1" button enters a number—a binary 0 or a binary 1—into the latch circuit comprising resistor 100 and buffer 102, and the value of this number depends on the signal present on line 90, which is connected to the input terminal of the "1" button. The signal that is present on line 90 is determined by the arrangement of the cartridge printed-circuit board, which is represented in FIG. 11 by dashed lines 84. In the particular arrangement of connectors illustrated in FIG. 11, line 86 represents one of the conductors on the cartridge printed-circuit board, its upper end representing one of the contact-spring landing areas 68 shown in FIGS. 5 and 6. Line 90 represents the conductor that is connected to the contact spring that engages the landing area represented by the upper end of line 86. The other end of line 86 represents another contact-spring landing area, the one that is electrically connected through a cartridge conductor path with the landing area represented by the upper end of line 86. Upon engagement of the electronics unit 36 and the cartridge, line 86 connects line 90 and line 119, a conductor on the electronics-unit printed-circuit board that is connected to another contact spring. A high signal—that is, a logic "1" signal—is present on line 119, so operation of the "1" button causes the latch that includes buffer 102 to go high; that is, operation of the "1" button connects two terminals, lines 94 and 119 of the comparison-and-storage circuitry in order to enter a number, a binary 1, into the circuitry.

It will be appreciated that the number represented by the "1" button depends on the arrangement of the connector means 84. This is illustrated, for example, by the "8" button, which connects a different pair of terminals of the storage-and-comparison circuit, in this case the terminals at the ends of lines 94 and 114. Connection of this pair of terminals causes entry of the binary number 0 into the storage-and-comparison circuitry, but it is apparent that the connection means 84 could easily be arranged differently so as to cause the operation of the "8" button to enter a binary 1.

Similar arrangements exist for each of the number buttons; each has an output terminal connected to one of the buffers 102, 106, 108, and 110, and some of them are dependent on the arrangement of the connector means for the determination of which number it is that they enter into the storage-and-comparison circuit. Others, specifically the "5", "0", "4", and "6" buttons, are all independent of the arrangement of the connector means. This arrangement is but one embodiment of the present invention, of course, and more or fewer of the buttons could be made dependent upon the arrangement of the connector means 84.

When the operator plays the game, he first presses the CLEAR button, which, as can be seen in FIG. 11, sets all the latches 102, 106, 108, and 110 to 0. For instance, pressing of the CLEAR button connects the cathode of diode 98 to ground, forward biasing it to give it a low impedance and thereby drawing the input terminal of buffer 102 low. This causes a low signal to be present at the output of buffer 102 and thus at its input terminal so that the buffer remains low after the CLEAR button is released. Latches 106, 108, and 110 are also operated this way.

Once the circuit is cleared, the operator enters his question code, for instance, the decimal number 10, by pressing the "1" and "0" buttons. This causes latch 102 to go high and latch 106 to remain low, while latches 108 and 110, which were set low by the CLEAR button, also remain low. The outputs of latches 102 and 106 are applied to an exclusive-OR gate 104, which results in a high output of gate 104. Since both of the inputs to another exclusive-OR gate 112 are low, the output signal from gate 100 is low. The outputs of gates 104 and 112 are each applied as one of the inputs to gates 126 and 130, respectively. Thus, one of the inputs to a second stage of exclusive-OR gates 126 and 130 is set by the entry of the question code. In other words, the question code 10 is interpreted according to the directions of the connection means 84 as a binary 10. Were the connection means 84 arranged otherwise, the question code 10 could be interpreted as a binary 0. Since the "0" button is hard-wired, the connection means 84 could not be rearranged to cause the question code 10 to be interpreted as a binary 1. It may be observed at this point that the circuit has performed a multivariate logical operation on the entered digits, an operation whose result depends on more than one operand. Two operands were mentioned in this example, but more could be used. In fact, question codes could be employed that depend on any number of entries, and the result would be dependent on most of the entries. As a consequence, the change in connector means does not only change the individual entries; it changes the values resulting from an unlimited number of question codes. Therefore, the multivariate operations are employed to multiply the effect of a connector change, so the storage required, even for a large number of questions, is minuscule.

In order to enter the other input to each of the exclusive-OR gates 126 and 130, the letter buttons are operated according to the answer code. As is apparent, buffers 116 and 124 constitute latches of the same type as latches 102, 106, 108, and 110, and they are also set low by operation of the CLEAR button. A binary number is recorded on these latches by the operation of one of the letter buttons. For instance, operation of the "A" button causes a high signal to be present on line 118, setting latch 116 high. It also causes a high signal to be present on line 120, so latch 124 is also set high. Thus, the "A" button represents the binary number 11. By similar reasoning, it can be seen that the "B" button enters 10, the "C" button enters 01, and the "D" button enters 00.

Assuming that the operator has picked the correct answer, which in this case is B because B encodes to the same number as does the question code, two high signals will be present at the inputs to gate 126, and two low signals will be present at the inputs to gate 130. Since the inputs to gate 126 are both the same, the output of gate 126 is low. The output of gate 130 is low for the same reason. The low signals present as the outputs of gates 126 and 130 back bias diodes 128 and 132, permitting a ground signal to be present at the input terminals of inverting buffers 134 and 138, both of whose outputs are thereby high.

When the operator presses the ANSWER button to determine whether he is correct, power is applied to the anode of LED 136, the red, or NO, indicator. However, since a high signal is also present at the cathode of LED 136, it does not light. On the other hand, the output of inverting amplifier 138 is high, and this signal is applied to the input terminal of inverting amplifier 142, which accordingly has a low output signal that is applied to the anode of LED 144, the green YES indicator. Thus, a green YES indication is shown to the operator.

In addition to the visual indication, a sound signal is provided when power is applied through the ANSWER button to a piezoelectric device 162, which is in the feedback circuit, along with resistor 158, of an inverting amplifier 156. The high signal present at the output of amplifier 138 forward biases diode 140, so the input to inverting amplifier 146 is a high signal from a low-impedance source that overcomes any feedback signal. Thus, the output of inverting amplifier 146 stays low, keeping the succeeding inverting amplifier 152 output high, which back biases diode 154 to insulate the input of amplifier 156 from the effects of the preceding circuitry. Thus, amplifier 156 is in a feedback configuration that oscillates at the natural frequency of the piezoelectric device 162. This causes mechanical vibration of the device, and a high-pitched tone is produced that is detectable by the operator. Having chosen the correct answer, the operator receives a green light and a high-pitched tone.

If, instead of choosing answer B, the operator had pressed button "A," he would have entered the binary number 11, which does not equal the 10 to which the question code was translated according to the arrangement of the connector 84. Specifically, though the inputs to gate 126 are still the same, producing a low signal at its output, the inputs to gate 130 are not the same, so the output of gate 130 goes high, forward biasing diode 132 and applying a high signal to the inputs of inverting amplifiers 134 and 138. Thus, amplifiers 134 and 138 now have low output signals, which turns on the red LED 136 and prevents the green LED 144 from coming on. In addition, the low signal at the output of amplifier 138 back biases diode 140, which relegates inverting amplifier 146 to the influence of its feedback circuit. This permits the circuit comprising amplifiers 146 and 152, resistor 148, and capacitor 150 to act as an oscillator. The result is that the output of amplifier 152 oscillates instead of being kept high, and this permits diode 144 to be forward biased. The output of amplifier 152 can then be applied to the input terminal of amplifier 156, overcoming its feedback signal and driving it at a frequency determined by the preceding oscillator rather than the natural frequency of the piezoelectric device 162. Resistor 148 and capacitor 150 are picked to provide an oscillator frequency that is lower than the natural frequency of the piezoelectric device 162, so the operator hears a low-pitched tone.

Diode 160 is provided to minimize the oscillations that otherwise would occur in the piezoelectric device 162 when power is not applied through the ANSWER button.

It should be noted that operation of the ANSWER key does not cause comparison of the entered numerical values. In the particular circuit of FIG. 11, the circuit is operated to compare the numerical values by operation of the keys depressed to enter them. The ANSWER key merely triggers conversion of the comparison signal into a humanly detectable translation.

A review of the circuit of FIG. 11 indicates it to be an embodiment of the same invention that is exemplified by the circuit of FIG. 9. It can be seen that connector 84 is a removable connector means that can be connected to some of the terminals of the storage-and-comparison circuit. In particular, it is connectable to lines 114 and 119. At the same time, it is connectable to some of the keyboard terminals, in particular, the input terminals to buttons 1, 8, 3, 7, 2, and 9. By means of the connector 84, pairs of storage-comparison-circuit terminals such as lines 94 and 119 can be connected through the operation of the keys of the keyboard, and operation of the keys enters numbers into the storage-and-comparison circuitry. Terminals such as the output terminals of inverting amplifiers 134 and 138 are provided in the storage-and-comparison circuitry to indicate the results of the comparison of the entered numbers, and the circuitry in FIG. 11 to the right of inverting amplifiers 134 and 138 constitute means for producing a humanly detectable version of the signals produced at their outputs.

Having thus described the invention, I claim:

1. In an apparatus for playing a question-and-answer game, the combination comprising:

a. a storage-and-comparison circuit including storage-and-comparison-circuit terminals, numerical values being enterable by connection of pairs of said storage-and-comparison-circuit terminals, and said circuit being operable by connection of pairs of said storage-and-comparison-circuit terminals to perform a multivariate logical operation on entered numerical values to enter a resultant numerical value and to compare the resultant numerical value with an entered numerical value, at least one comparison-result terminal being provided for carrying signals indicative of the result of said comparison;

b. a keyboard having keyboard terminals and a multiplicity of keys each labeled with a distinction indicium, associated with a pair of keyboard terminals, and operable to connect them;

c. a removable question-and-answer unit including a base having connector means thereon and listing means attached thereto, said connector means being removably electrically connected simultaneously to some of said storage-and-comparison-circuit terminals and some of said keyboard terminals and providing connection circuitry electrically connecting some of said storage-and-comparison-circuit terminals to some of said keyboard terminals for connection of some of said storage-and-comparison-circuit terminal pairs upon operation of some of said keys, said connection circuitry being arranged for entry of numerical values and performance by said storage-and-comparison circuit of said logical operation upon operation of some of said key and comparison of the resultant numerical value with an entered numerical value upon operation of at least one of said keys when said removable connector means is simultaneously connected to said keyboard terminals and said storage-and-comparison-circuit terminals, whereby the resultant numerical value entered by operation of said keys can be changed by substituting a connector means in which the connection circuitry is arranged differently between said storage-and-comparison-circuit terminals and said keyboard terminals, said listing means providing a listing of questions and associated sets of answers, some of said questions being associated with a question code consisting of at least two of said keyboard indicia, one answer of each set being predetermined the correct answer, each answer being associated with an answer code consisting of at least one of said keyboard indicia, said connector means thereby establishing a correspondence between question codes and answer codes, the resultant numerical value entered by operation of the keys labeled with the indicia of which a question code consists being equal, when said connector means is connected to said storage-and-comparison-circuit and keyboard terminals, to the numerical value entered by operation of the key labeled with the indicia of which the associated correct-answer code consists, said listing means thereby uniquely matching the correspondence established by said connector means; and d. indicator means connected to said comparison-result terminal of said storage-and-comparison circuit, said indicator means producing a humanly detectable translation of said signals present on said comparison-result terminal.

2. The apparatus combination of claim 1, wherein some of said storage-and-comparison-circuit terminal pairs each consist of a logic-signal terminal presenting a logic "0" or logic "1" signal and an entry terminal for entering into said storage-and-comparison circuit as a digital number a signal impressed thereon; and wherein said connector means is arranged for electrical connection of some of said logic signal/entry terminal pairs of said storage-and-comparison circuit through operation of some of said keys;

whereby the numerical values entered upon operation of some of said keys are dependent upon the connection circuitry of said connector means.

3. The apparatus combination of claim 2, wherein said connector means includes a printed-circuit board and said connection circuitry includes electrically conductive landing areas and electrically conductive paths that electrically connect pairs of said landing areas; and wherein said keyboard terminals and storage-and-comparison-circuit terminals electrically connected to said connector means are electrically connected to said landing areas by conductors connected to said terminals and terminating in electrically conductive contact members removably contacting said landing areas of said printed-circuit board, whereby a keyboard terminal electrically connected to a first of said landing areas is electrically connected to the storage-and-comparison-circuit terminal connected to the landing area to which said first landing area is connected by said printed-circuit-board paths.

4. The apparatus combination of claim 1, wherein said storage-and-comparison circuit includes an integrated-circuit calculator chip, said logical operation being an arithmetic operation;

wherein sequential connection of some pairs of said storage-and-comparison-circuit terminals enters operand numerical values into said calculator chip and causes it to perform said arithmetic operation on said operands, the resultant numerical value being the answer to said arithmetic operation; and wherein said connection circuitry is arranged for said sequential connection of storage-and-comparison-circuit terminals upon sequential operation of some of said keys, whereby a code can consist of a sequence of characters that corresponds to said sequential operation of keys, operation of said keys corresponding to said code thereby entering the numerical value that is the answer to said arithmetic operation.

5. The apparatus combination of claim 4, wherein said connector means includes a printed-circuit board and said connection circuitry includes electrically conductive landing areas and electrically conductive paths that electrically connect pairs of said landing areas; and wherein said keyboard terminals and storage-and-comparison-circuit terminals electrically connected to said connector means are electrically connected to said landing areas by conductors connected to said terminals and terminating in electrically conductive contact members removably contacting said landing areas of said printed-circuit board, whereby a keyboard terminal electrically connected to a first of said landing areas is electrically connected to the storage-and-comparison-circuit terminal connected to the landing area to which said first landing area is connected by said printed-circuit-board paths.

6. The apparatus combination of claim 1, wherein one terminal of each keyboard terminal pair is denominated the input terminal and the other terminal of each keyboard terminal pair is denominated the output terminal associated with said input terminal;

wherein some of said output terminals are directly connected to some of said storage-and-comparison-circuit terminals;

wherein said connector means is arranged to connect some of said input terminals that are associated with directly connected output terminals to some of said storage-and-comparison-circuit terminals.

7. The apparatus combination of claim 6, wherein some of said storage-and-comparison-circuit terminal pairs each consist of a logic-signal terminal presenting a logic "0" or logic "1" signal and an entry terminal for entering into said storage-and-comparison circuit as a digital number a signal impressed thereon; and, wherein said connector means is arranged for electrical connection of some of said logic signal/entry terminal pairs of said storage-and-comparison circuit through operation of some of said keys, whereby the numerical values entered upon operation of some of said keys are dependent upon said connection circuitry of said connector means.

8. The apparatus combination of claim 7, wherein said connector means includes a printed-circuit board and said connection circuitry includes electrically conductive landing areas and electrically conductive paths that electrically connect pairs of said landing areas; and wherein said keyboard terminals and storage-and-comparison-circuit terminals electrically connected to said connector means are electrically connected to said landing areas by conductors connected to said terminals and terminate in electrically conductive contact members removably contacting said landing areas of said printed-circuit board, whereby a keyboard terminal electrically connected to a first of said landing areas is electrically connected to the storage-and-comparison-circuit terminal connected to the landing area to which said first landing area is connected by said printed-circuit-board paths.

9. The apparatus combination of claim 6, wherein said storage-and-comparison circuit includes an integrated-circuit calculator chip, said logical operation being an arithmetic operation;

wherein sequential connection of some pairs of said storage-and-comparison-circuit terminals enters operand numerical values into said calculator chip and causes it to preform said arithmetic operation on said operands, the resultant numerical value being the answer to said arithmetic operation; and wherein said connection circuitry is arranged for said sequential connection of storage-and-comparison-circuit terminals upon sequential operation of some of said keys, whereby a code can consist of a sequence of characters that corresponds to said sequential operation of keys, operation of said keys corresponding to said code thereby entering the numerical value that is the answer to said arithmetic operation.

10. The apparatus combination of claim 9, wherein said connector means includes a printed-circuit board and said connection circuitry includes electrically conductive landing areas and electrically conductive paths that electrically connect pairs of said landing areas; and wherein said keyboard terminals and storage-and-comparison-circuit terminals electrically connected to said connector means are electrically connected to said landing areas by conductors connected to said terminals that terminate in electrically conductive contact members removably contacting said landing areas of said printed-circuit board, whereby a keyboard terminal electrically connected to a first of said landing areas is electrically connected to the storage-and-comparison-circuit terminal connected to the landing area to which said first landing area is connected by said printed-circuit-board paths.

11. The apparatus combination of claim 1, wherein said connector means includes a printed-circuit board and said connection circuitry includes electrically conductive landing areas and electrically conductive paths that electrically connect pairs of said landing areas; and wherein said keyboard terminals and storage-and-comparison-circuit terminals electrically connected to said connector means are electrically connected to said landing areas by conductors connected to said terminals and terminating in electrically conductive contact members removably contacting said landing areas of said printed-circuit board, whereby a keyboard terminal electrically connected to a first of said landing areas is electrically connected to the storage-and-comparison-circuit terminal connected to the landing area to which said first landing area is connected by said printed-circuit-board paths.

12. The apparatus combination of claim 1, wherein said listing means comprises a booklet bearing a visual listing of said questions, answers, and codes.

13. The apparatus combination of claim 12, wherein said indicator means includes an indicator light connected for illumination upon reception by said indicator means of signals on said comparison-result terminal indicating the equality of said compared numerical values.

14. The apparatus combination of claim 13, wherein said indicator means comprises two indicator lights, one of which is arranged for illumination upon reception of a signal indicating equality of said compared numerical values, the other indicator light being arranged for illumination upon reception by said indicator means of a signal indicating inequality of said compared numerical values.

15. The apparatus combination of claim 14, wherein said indicator means further include sound-generating means for selectively producing one of two distinct tones, said sound-generating means being arranged for production of a first of said tones upon reception of a signal from said comparison-result terminal indicating equality of said compared numerical values and for production of the other of said tones upon reception of a signal from said comparison-result terminal indicating their inequality.

16. In an apparatus for playing a question-and-answer game, the combination comprising:

a. an electronics unit including a housing and a storage-and-comparison circuit within said housing, said electronics unit being adapted to accept question codes and including a keyboard having a multiplicity of keys each labeled with a distinctive indicium and operatively connected to said storage-and-comparison circuit for entering answer numerical values thereinto, and storage-and-comparison circuit being operable to generate resultant numerical values by performing a common logical operation on all question codes accepted by said electronics unit and to compare said resultant numerical values with said answer numerical values, said electronics unit further including indicator means for producing a humanly detectable indication of the outcome of said comparison; and b. a question-and-answer unit removably attached to said electronics unit and including a base and cartridge means and listing means attached to said base, said cartridge means being removably electrically connected to said storage-and-comparison circuit for removal of said question-and-answer unit from said electronics unit by removal of said cartridge means from said storage-and-comparison circuit, the resultant numerical values generated by said storage-and-comparison circuit being dependent on the arrangement of said cartridge means, said listing means providing a listing of questions and question codes and associated sets of answers and answer codes, each of said questions being associated with a question code, one answer of each set being predetermined the correct answer, each answer being associated with an answer code consisting of at least one of said keyboard indicia, said cartridge thereby establishing a correspondence between question codes and answer codes, the resultant numerical value generated from said question code when said cartridge means is electrically connected to said storage-and-comparison circuit being equal to the answer numerical value entered by operating each key associated with the at least one keyboard indicium included in said correct answer code, said listing means thereby uniquely matching the correspondence established by said cartridge means, whereby a change in the questions and answers can be effected at the same time as a change in the correspondence between question codes and answer codes by removing said question-and-answer unit from said electronics unit and replacing it with a different question-and-answer unit having differently arranged cartridge means and listing means with different questions and answers.

17. A method of changing numerical values entered by operation of keys into a storage-and-comparison circuit comprising the steps of:

a. providing a storage-and-comparison circuit including storage-and-comparison-circuit terminal, numerical values being enterable by connection of pairs of said storage-and-comparison-circuit terminals, said circuit being operable by connection of pairs of said storage-and-comparison-circuit terminals to perform a multivariate logical operation on entered numerical values to enter a resultant numerical value and to compare the resultant numerical value with an entered numerical value, at least one comparison-result terminal being provided for carrying signals indicative of the result of said comparison;

b. providing a keyboard having keyboard terminals and a multiplicity of keys each labeled with a distinctive indicium, associated with a pair of keyboard terminals, and operable to connect them;

c. providing a first removable question-and-answer unit including a first base having first connector means thereon and first listing means attached thereto, said first connector means being removably electrically connected simultaneously to some of said storage-and-comparison-circuit terminals and some of said keyboard terminals and providing connection circuitry electrically connecting some of said storage-and-comparison-circuit terminals to some of said keyboard terminals for connection of some of said storage-and-comparison-circuit terminal pairs upon operation of some of said keys, said connection circuitry being arranged for entry of numerical values and performance by said storage-and-comparison circuit of said logical operation upon operation of some of said keys, said connection circuitry being arranged for comparison of the resultant numerical value with an entered numerical value upon operation of at least one of said keys when said connector means is simultaneously connected to said keyboard terminals and said storage-and-comparison-circuit terminals, whereby the resultant numerical value entered by operation of said keys can be changed by substituting a connector means in which the connection circuitry is arranged differently between said storage-and-comparison-circuit terminals and said keyboard terminals, said first listing means providing a first listing of questions and associated sets of answers, some of said questions being associated with a question code consisting of at least two of said keyboard indicia, one answer of each set being predetermined the correct answer, each answer being associated with an answer code consisting of at least one of said keyboard indicia, said connector means thereby establishing a correspondence between question codes and answer codes, the resultant numerical value entered by operation of the keys labeled with the indicia of which a question code consists being equal, when said first connector means is connected to said storage-and-comparison-circuit terminals and said keyboard terminals, to the numerical value entered by operation of each key labeled with the at least one indicium of which the associated correct-answer code consists, said listing means thereby uniquely matching the correspondence established by said connector means;

d. removing said first removable question-and-answer unit to disconnect said first connector means from said storage-and-comparison circuit terminals and said keyboard terminals, thereby also removing said first listing means;

e. providing a second removable question-and-answer unit including a second base having second connector means thereon and second listing means attached thereto, said second connector means being adapted to be removably electrically connected simultaneously to some of said storage-and-comparison-circuit terminals and some of said keyboard terminals and having connection circuitry adapted to electrically connect some of said storage-and-comparison-circuit terminals to some of said keyboard terminals for connection of some of said storage-and-comparison-circuit-terminal pairs upon operation of some of said keys, said connection circuitry of said second connection means being arranged for entry of numerical values and performance by said storage-and-comparison circuit of said logical operation upon operation of some of said keys, said connection circuitry being arranged for comparison of the resultant numerical value with an entered numerical value upon operation of at least one of said keys when said second connector means is simultaneously connected to said keyboard terminals and said storage-and-comparison-circuit terminals, the resultant numerical values entered by operation of said keys when said second connection means is connected to said storage-and-comparison-circuit terminals and said keyboard terminals differing from the resultant numerical values entered by operation of said keys when said first connector means is connected to said storage-and-comparison-circuit terminals and said keyboard terminals, said second listing means providing a listing of questions and associated sets of answers that differ from the questions and answers of said first listing means, some of said questions of said second listing means being associated with a question code consisting of at least two of said keyboard indicia, one answer of each set on said second listing means being predetermined the correct answer, each answer being associated with an answer code consisting of at least one of said keyboard indicia, said second connector means thereby establishing a correspondence between question codes and answer codes, the resultant numerical value entered by operation of the keys labeled with the indicia of which a question code on said second listing means consists being equal, when said second connector means is connected to said storage-and-comparison-circuit terminals and said keyboard terminals, to the numerical value entered by operation of the key labeled with the indicia of which the associated correct-answer code consists, said second listing means thereby uniquely matching the correspondence established by said second connector means; and f. attaching said second question-and-answer unit to said storage-and-comparison circuit to connect said second removable connector means to some of said storage-and-comparison-circuit terminals and some of said keyboard terminals, thereby changing the correspondence between question codes and correct-answer codes and simultaneously providing said second listing of questions and answers uniquely matching the correspondence established by said second connector means.

18. A method of changing numerical values entered into a storage-and-comparison circuit by operation of keys comprising the steps of:

a. providing an electronics unit including a housing and a storage-and-comparison circuit within said housing, said electronics unit being adapted to accept question codes and including a keyboard having a multiplicity of keys each labeled with a distinctive indicium and operatively connected to said storage-and-comparison circuit for entering answer numerical values thereinto, said storage-and-comparison circuit being operable to generate resultant numerical values by performing a common logical operation on all question codes accepted by said electronics unit to compare said resultant numerical values with said answer numerical values, said electronics unit further including indicator means for producing a humanly detectable indication of the outcome of said comparison;

b. providing a first question-and-answer unit removably attached to said electronics unit and including a first base and first cartridge means and first listing means attached to said base, said cartridge means being removably connected to said storage-and-comparison circuit for removal of said cartridge means from said storage-and-comparison circuit by removal of said question-and-answer unit from said electronics unit, the resultant numerical values generated by said storage-and-comparison circuit being dependent on the arrangement of said cartridge means, said listing means providing a listing of questions and question codes and associated sets of answers and answer codes, each of said questions being associated with a question code, one answer of each set being predetermined the correct answer, each answer being associated with an answer code consisting of at least one of said keyboard indicia, said cartridge thereby establishing a correspondence between question codes and answer codes, the resultant numerical value generated from a question code when said cartridge means is electrically connected to said storage-and-comparison circuit being equal to the answer numerical value entered by operating each key associated with the at least one keyboard indicium included in said correct-answer code, said first listing means thereby uniquely matching the correspondence established by said first cartridge means, whereby a change in the questions and answers can be effected at the same time as a change in the correspondence between question codes and answer codes by removing said question-and-answer unit from said electronics unit and replacing it with a different question-and-answer unit having differently arranged cartridge means and listing means with different questions and answers;

c. removing said first question-and-answer unit from said electronics unit, thereby disconnecting said first cartridge means from said storage-and-comparison circuit and simultaneously removing said listing means;

d. providing a second question-and-answer unit adapted to be removably attached to said electronics unit and including a second base and second cartridge means and second listing means attached to said second base, said second cartridge means being adapted to be removably electrically connected to said storage-and-comparison circuit upon attachment of said second question-and-answer unit, the resultant numerical values generated by said storage-and-comparison circuit when said second cartridge means is electrically connected thereto differing from the resultant numerical values generated by said storage-and-comparison circuit when said first cartridge means is connected thereto, said second listing means providing a listing of questions and question codes and associated sets of answers and answer codes that differ from said questions and answers on said first listing means, each of said questions on said second listing means being associated with a question code, one answer of each set on said second listing means being predetermined the correct answer, each answer on said second listing means being associated with an answer code consisting of at least one of said keyboard indicia, said second cartridge means thereby establishing a correspondence between question codes and answer codes that differs from the correspondence established by said first cartridge means, the resultant numerical value generated from said question code when said second cartridge means is electrically connected to said storage-and-comparison circuit being equal to the answer numerical value entered by operating each key associated with the at least one keyboard indicium included in said correct-answer code, said second listing means thereby matching the correspondence established by said second cartridge means but not that established by said first cartridge means; and e. attaching said second question-and-answer unit to said electronics unit to connect said second cartridge means to said storage-and-comparison circuit, thereby simultaneously attaching said second listing means.

* * * * *

UNITED STATES PATENT AND TRADEMARK OFFICE

CERTIFICATE OF CORRECTION

PATENT NO. : 4,303,398

DATED : December 1, 1981

INVENTOR(S) : MARK L. YOSELOFF

It is certified that error appears in the above-identified patent and that said Letters Patent are hereby corrected as shown below:

Column 15, line 47, "key" should be -- keys --

Signed and Sealed this

*Fifteenth* Day of *June 1982*

[SEAL]

*Attest:*

GERALD J. MOSSINGHOFF

*Attesting Officer*

*Commissioner of Patents and Trademarks*